United States Patent [19]

Mukoyama

[11] Patent Number: 4,666,312

[45] Date of Patent: May 19, 1987

[54] TABLE CLOCK

[75] Inventor: Masumi Mukoyama, Tokyo, Japan

[73] Assignee: Seikosha Co., Ltd., Tokyo, Japan

[21] Appl. No.: 903,684

[22] Filed: Sep. 4, 1986

[30] Foreign Application Priority Data

Sep. 6, 1985 [JP] Japan ..... 60-136511

[51] Int. Cl.[4] ..... G04B 17/02

[52] U.S. Cl. ..... 368/179; 368/229

[58] Field of Search ..... 368/76, 165, 179, 223, 368/228, 229; 40/426, 439

[56] References Cited

U.S. PATENT DOCUMENTS 4,421,421 12/1983 Bradt ..... 368/179
4,468,132 8/1984 Nakamura ..... 368/179
4,544,282 10/1985 Giraldez ..... 368/165
4,600,315 7/1986 Nakamura ..... 368/179
4,613,236 9/1986 Nakamura ..... 368/179

*Primary Examiner*—Vit W. Miska
*Attorney, Agent, or Firm*—Robert E. Burns; Emmanuel J. Lobato; Bruce L. Adams

[57] ABSTRACT

A table clock characterized in that two pendulum rods are swingably supported on either side of a support body in symmetrical positional relation, bobs are attached to the lower ends of the respective pendulum rods, the upper end portions of the two pendulum rods are mutually interlinked by a coupling rod, a vertical rod is coupled to the middle of the coupling rod, and a clock body and a bob are attached, respectively, to the upper end and the lower end of the vertical rod.

1 Claim, 2 Drawing Figures

TABLE CLOCK

BACKGROUND OF THE INVENTION

This device relates to a table clock possessing dynamic interior decorationity.

Hitherto, one type of table clock is known which possesses interior decorationity by incorporation of mobility, such as "Overall Swingable Clock (Japanese Patent Laid-Open No. 56-49972)". This type is designed so that the whole clock body can swing reciprocatingly, hence, this type of table clock possesses dynamic interior decorationity, as well as the ordinary function of displaying the time of day.

However, this type of table clock of the prior art provides only a very simple movement, is insufficient in interior decorationity, and has the defect that it is very difficult to read the time because the time display section of the clock body is also rotatingly displaced.

In view of the foregoing, it is an object of the present device to provide a table clock which presents a more complicated movement to enhance interior decorationity and permits very easy reading of the time.

The feature of the present device is that two pendulum rods are swingably supported on either side of a support body in symmetrical positional relation, bobs are attached to the lower ends of the respective pendulum rods, the upper end portions of the two pendulum rods are mutually interlinked by a coupling rod, a vertical rod is coupled to the middle of the coupling rod, and a clock body and a bob are attached, respectively, to the upper end and the lower end of the vertical rod.

Accordingly, as a lateral force is applied to the coupling rod, the pendulum rods begin swinging from side to side, but, the vertical rod always maintains its vertical condition, thus, although moving horizontally reciprocatingly from side to side, the clock body at the upper end of the vertical rod can always be looked at upright.

2: support body,

4,4: pendulum rod,

6,6: coupling pin,

9,9: coupling member,

11: coupling member,

14: bob,

3,3: coupling member,

5,5: bob,

8,8: coupling member,

10: coupling rod,

13: vertical rod,

15: clock body.

DETAILED DESCRIPTION OF THE INVENTION

An embodiment of the present device will now be described with reference to the drawings.

Figure 1:
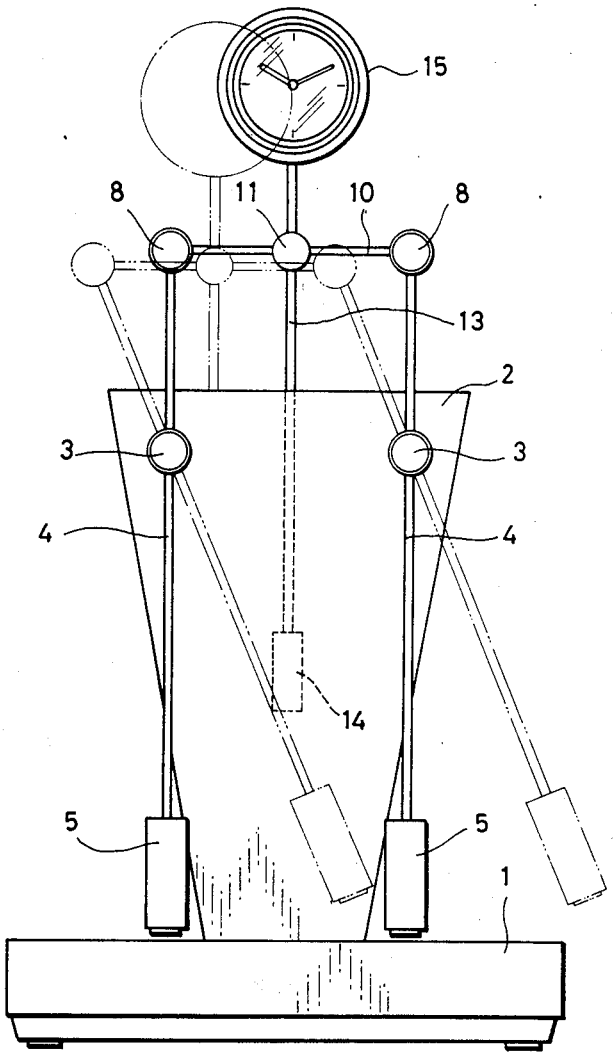
FIG. 1 is a front view.
Figure 2:
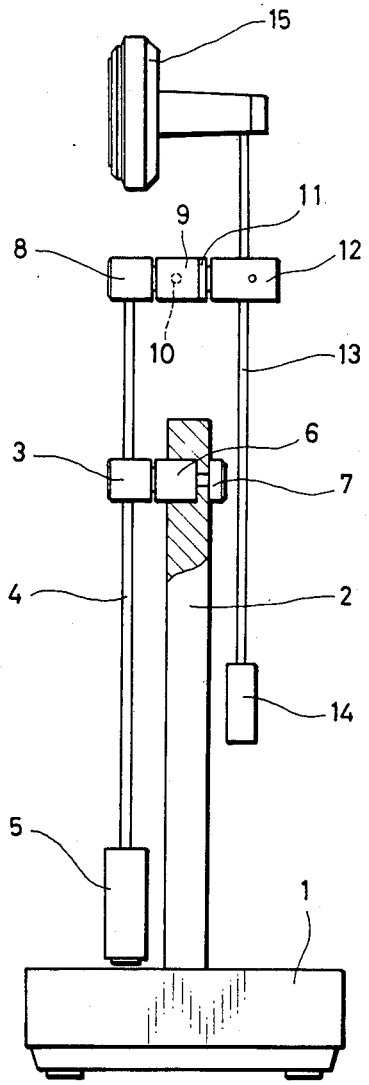
FIG. 2 is a side view with a portion broken away.

As shown in FIG. 1, on a base 1 is erected a support plate 2 which is a support body of the form of an inverted triangle, on either side portion of the front upper section of this support plate are swingably supported two pendulum rods 4, 4 in symmetrical positional relation via rotatable coupling members 3, 3, and to the lower ends of the respective pendulum rods are attached bobs 5, 5, respectively. The configuration of the pendulum rods 4, 4 being attached to the coupling members 3, 3 is as shown in FIG. 2, in which a coupling pin 6 is secured by a screw 7 to the support plate 2 and to this coupling pin is rotatably coupled the coupling member 3. The center of gravity each of the pendulum rods 4, 4 lies below the respective coupling members 3, 3. To the upper ends of the respective pendulum rods 4, 4 are secured coupling members 8, 8 as shown in FIG. 2, to the rear each of these coupling members are rotatably coupled coupling members 9, 9, and between or to these coupling members 9, 9 are coupled or interlinked the ends of a coupling rod 10 (FIG. 1).

To the middle portion of the coupling rod 10 is secured a coupling member 11, to this coupling member is secured a coupling member 12, to this coupling member 12 is coupled a vertical rod 13 perpendicularly with respect to the coupling rod 10, and to the lower end of this vertical rod is secured a bob 14 and to its upper portion a clock body 15.

As a lateral force is applied to the pendulum rods 4, 4 or to the coupling rod 10, these two pendulum rods begin swing motion, and in response thereto the vertical rod 13 also moves reciprocatingly from side to side while maintaining its upright posture, but, the clock body 15 is always in the front-looking state. Incidentally, the vertical rod 13 may be coupled swingably to the coupling rod 10.

According to the present device, since there is presented a variety of motion by the use only of a very simple configuration, the degree of interior decorationity is increased, and especially, since the vertical rod is displaced from side to side while maintaining its vertical posture, the time can be read very easily.

What is claimed is:

1. A table clock characterized in that two pendulum rods are swingably supported on either side of a support body in symmetrical positional relation, bobs are attached to the lower ends of the respective pendulum rods, the upper end portions of the two pendulum rods are mutually interlinked by a coupling rod, a vertical rod is coupled to the middle of the coupling rod, and a clock body and a bob are attached, respectively, to the upper end and the lower end of the vertical rod.

* * * * *